US005333744A

United States Patent [19]

LoCicero et al.

[11] Patent Number: 5,333,744

[45] Date of Patent: Aug. 2, 1994

[54] MODULAR EQUIPMENT SUPPORT SYSTEM

[75] Inventors: Rai-Ann LoCicero, Chelmsford; Stuart Morgan, both of Westford; Michael Romm, Brighton, all of Mass.; Matthew Bantly, Nashua, N.H.; Edward O. Mangan, Southboro, Mass.

[73] Assignee: Digital Equipment Corporation, Maynard, Mass.

[21] Appl. No.: 16,094

[22] Filed: Feb. 10, 1993

[51] Int. Cl.[5] ..... A47F 5/00

[52] U.S. Cl. ..... 211/87; 211/103; 248/214

[58] Field of Search ..... 211/87, 88, 13, 103; 248/214, 215

[56] References Cited

U.S. PATENT DOCUMENTS

| | | | |
|---|---|---|---|
| 2,066,822 | 1/1937 | Cohen | 211/87 X |
| 2,428,073 | 9/1947 | Handel | 211/87 |
| 3,536.286 | 10/1970 | Kramer | 211/87 X |
| 4,138,019 | 2/1979 | Smith | 248/214 X |
| 5,022,537 | 6/1991 | Henriquez | 211/88 |
| 5,125,518 | 6/1992 | Ward | 211/87 |

*Primary Examiner*—Robert W. Gibson, Jr.
*Attorney, Agent, or Firm*—Albert Cefalo; Denis G. Maloney; Barry Young

[57] ABSTRACT

A modular system for supporting equipment on a wall has support panels. Each panel includes a sheet having columns of keyholes, and a rear support surface lying in a plane parallel to and spaced behind the sheet. The rear support surface has keyholes near the top of the panel and fastener elements near the bottom of the panel. The fastener elements have the same spacing as the keyholes near the top of the panel. The fastener elements project from the plane of the rear support surface toward the front support surface to permit mating with keyholes near the top of another panel to be hung below it.

7 Claims, 2 Drawing Sheets

MODULAR EQUIPMENT SUPPORT SYSTEM

BACKGROUND OF THE INVENTION

This invention relates to modular supports for equipment.

Electronic equipment, for example of the kind used in interconnecting and serving cables which form a local area computer network, are typically mounted in heavy steel free-standing cabinets or racks.

The installer assembles the rack or cabinet from separate parts using bolts and mounts the pieces of equipment in the finished rack using screws. This is a relatively labor intensive activity. Installing additional equipment and rearranging old equipment are also labor intensive.

SUMMARY OF THE INVENTION

In general, in one aspect, the invention features a modular system for supporting equipment on a wall. The system has support panels (e.g., at least two identical panels). Each panel includes a sheet having columns of keyholes, and a rear support surface lying in a plane parallel to and spaced behind the steel sheet. The rear support surface has keyholes near the top of the panel and fastener elements near the bottom of the panel. The fastener elements have the same spacing as the keyholes near the top of the panel. The fastener elements project from the plane of the rear support surface toward the front support surface to permit mating with keyholes near the top of another panel to be hung below it.

Embodiments of the invention include the following features. The sheet is generally rectangular and the rear support surface extends below the bottom edge of the steel sheet. The keyholes in the steel sheet each have an upper round hole opening into a lower slot, and the keyholes in the rear support surface each have an upper slot opening into a lower round hole.

The system may include a U-shaped hanger for mounting over the top edge of a partition wall. The hanger has a front face with fastener elements projecting from the plane of the front face, the fastener elements having the same spacing as the keyholes in the rear support surface of each panel.

The keyholes in the sheet are set in (e.g., identically arranged pairs along both) columns.

The system may also include modular brackets for supporting equipment, each bracket having fastener elements arranged on the corners of a rectangle and spaced to match the spacing of pairs of the keyholes in the steel sheet, to permit the bracket to be mounted in different vertical positions on the panels.

There may also be identical modular covers for covering equipment supported on the modular brackets, each cover having fastener elements arranged on the corners of a rectangle and spaced to match the spacing of keyholes in the steel sheet, to permit the covers to be mounted one above another on the panels.

Among the advantages of the invention are the following.

Installation of the modular support system on a wall, and of equipment and covers on the support system is extremely simple and quick, and requires a minimum of hardware and tools. Changes can also be done quickly and easily.

Other advantages and features will become apparent from the following description and from the claims.

DESCRIPTION

Figure 1:
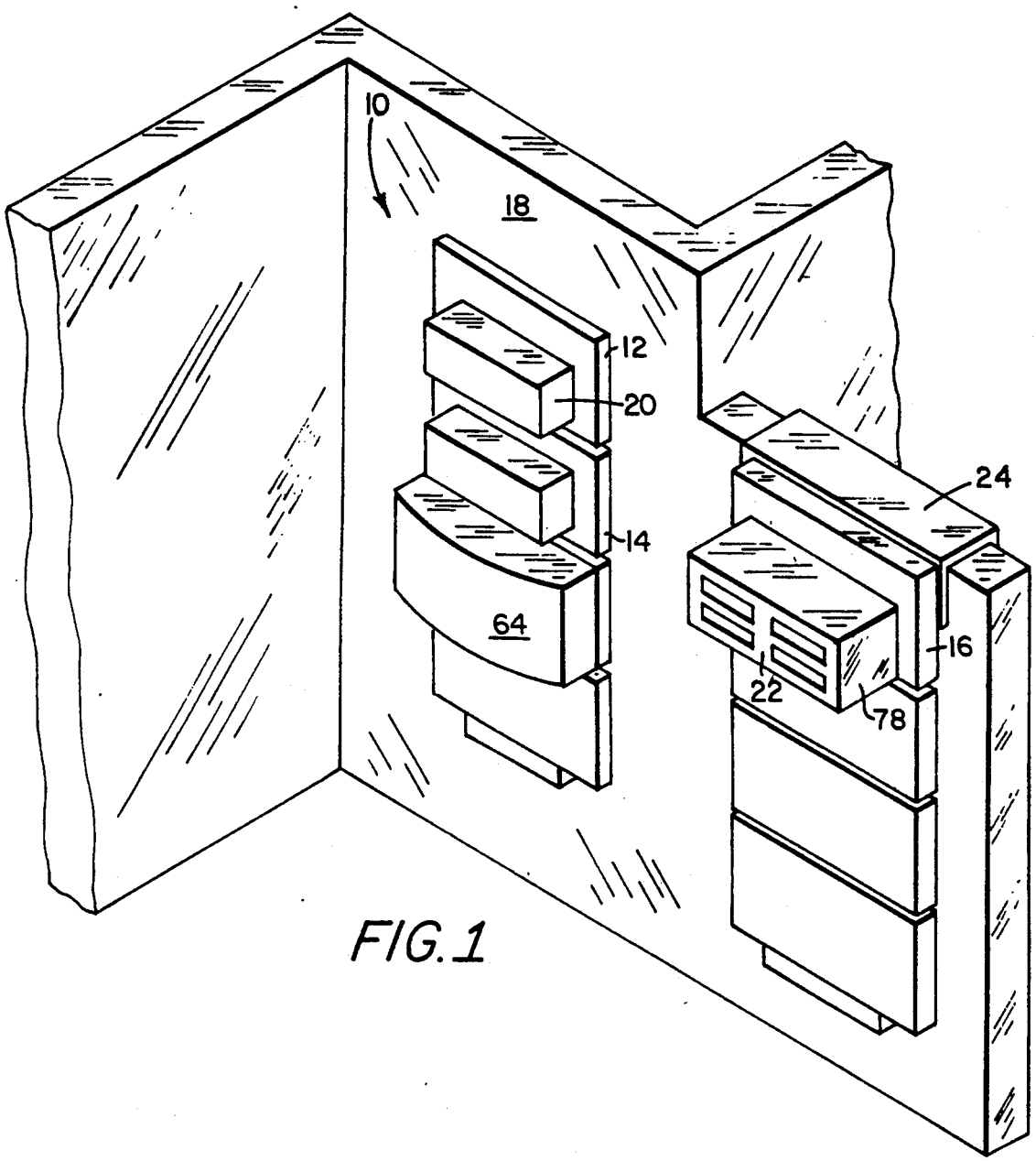
FIG. 1 is a schematic perspective view of equipment mounted on a modular support system hung on a wall.

Referring to FIG. 1, a modular rack system 10 includes a set of identical panels 12, 14, 16 suspended from a wall 18. Equipment (for example routers and bridges 20 for a local area computer network, or patch panels 22) is hung on the panels. Some components of the system may be hung from the top of a portion of the wall which does not rise to the ceiling, using a hanger 24.

Figure 2:
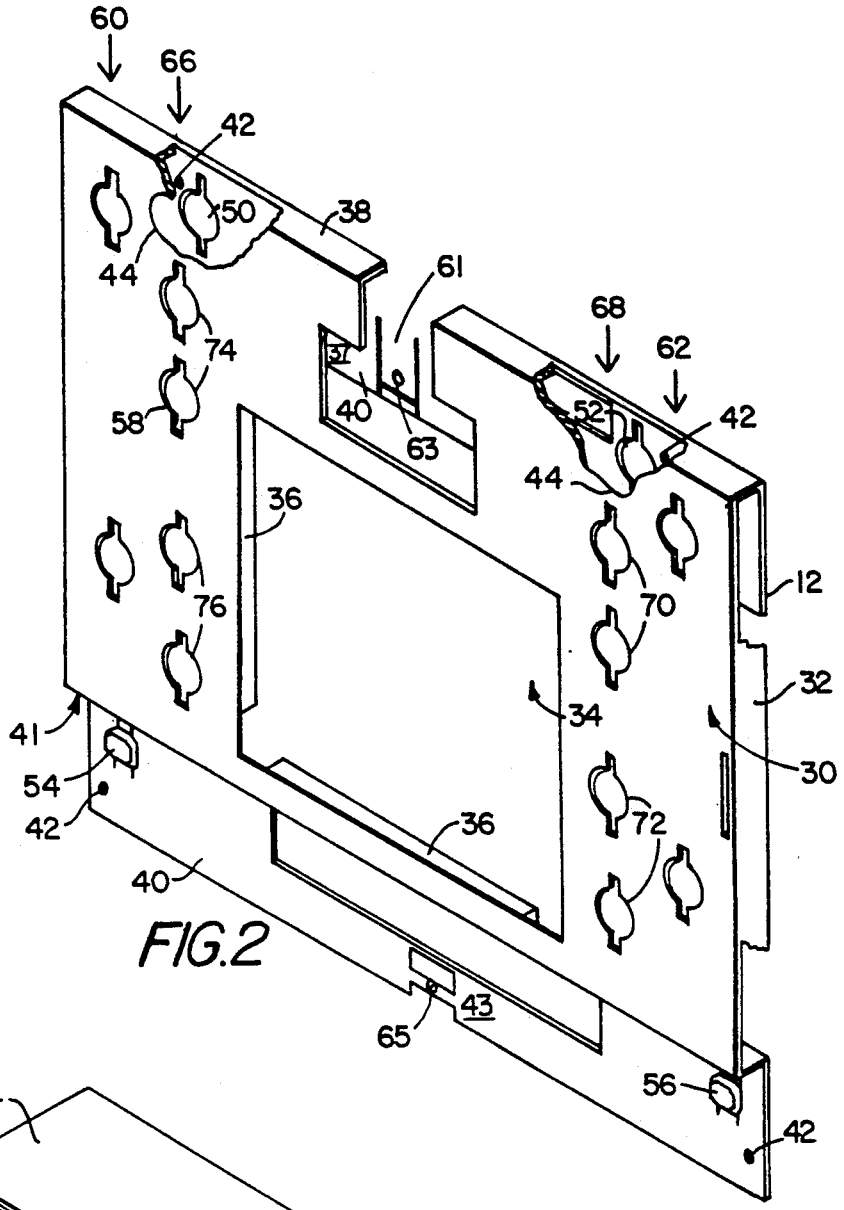
FIG. 2 is a perspective view, cut away, of a modular panel.

Referring to FIG. 2, each of the panels 12 is formed by cutting and pressing a steel sheet to form a rectangular front surface 30 with ribs 32 formed along all four edges for rigidity. A rectangular hole 34 for passing cable (not shown) also has ribs 36 formed on all four edges also for rigidity and to space the front surface 30 evenly from the wall.

The top rib 38 joins a rear support surface 40. Surface 40 has an upper portion 37 which serves to hang the panel either from a similar panel inunediately above, or from a hanger 24 (FIG. 1). The bottom rib 41 joins another portion 43 of the rear support surface 40 which serves to support a similar panel hung immediately below.

Four small screw holes 42 in the two portions of rear support surface 40 receive conventional screws to mount the panel directly to a wall. Two slots 44 in front surface 30 give clear access to the top two screw holes.

In upper portion 37 of rear support surface 40 are two keyholes 50, 52 which are configured to mate with two fastener elements 54 and 56 on the lower portion 43 of the rear support surface of a panel above. Details concerning the configuration of the fastener elements and slots are set forth in copending U.S. patent application Ser. No. 08/016,010, filed on the same day as this application, and incorporated by reference. Keyholes 50, 52 each have a round lower hole opening to an upper slot.

Upper portion 37 also has a finger 61 with a nipple 63 formed in the middle. The nipple seats in a dimple 65 of a panel above when one panel is suspended from another.

Four columns of keyholes 58 in front surface 30 accept fastener elements (like element 54) on equipment and parts which are to be mounted on the panel. Each keyhole 58 has an upper round hole opening to a lower slot. The equipment and parts to be hung could include a bracket to hold a patch panel as shown in copending U.S. patent application Ser. No. 08/016,103, filed on the same day as this application, and incorporated by reference; or a cover of the kind shown in U.S. patent application Ser. No. 08/016,010; or an almost limitless variety of other parts and equipment.

The four columns of keyholes 58 are arranged to permit modular hanging of covers and equipment on the support system. The outer two columns 60, 62 each have two keyholes. The vertical spacing of the keyholes in column 60 is the same as for column 62. These four keyholes can receive fastening elements formed on a modular cover 64 (FIG. 1). Similar covers may be mounted on other panels of the system to provide a continuous covering for all of the mounted equipment. Each of the inner two columns of keyholes 66, 68 each have four keyholes in two pairs 70, 72, 74, 76. The spacing of keyholes within a pair is the same as for the other three pairs. Two pairs, e.g., 70, 74, provide four keyholes to receive four fastener elements of an equipment bracket 78. Each panel can accommodate a second bracket using the two pairs of keyholes 72, 76.

Because the keyholes are repeated in columns, the parts and equipment to be hung on the rack may be located in a variety of different positions. Because the mating and unmating of the fasteners simply involves raising and lowering the equipment or parts, their locations can be easily changed.

Figure 3:
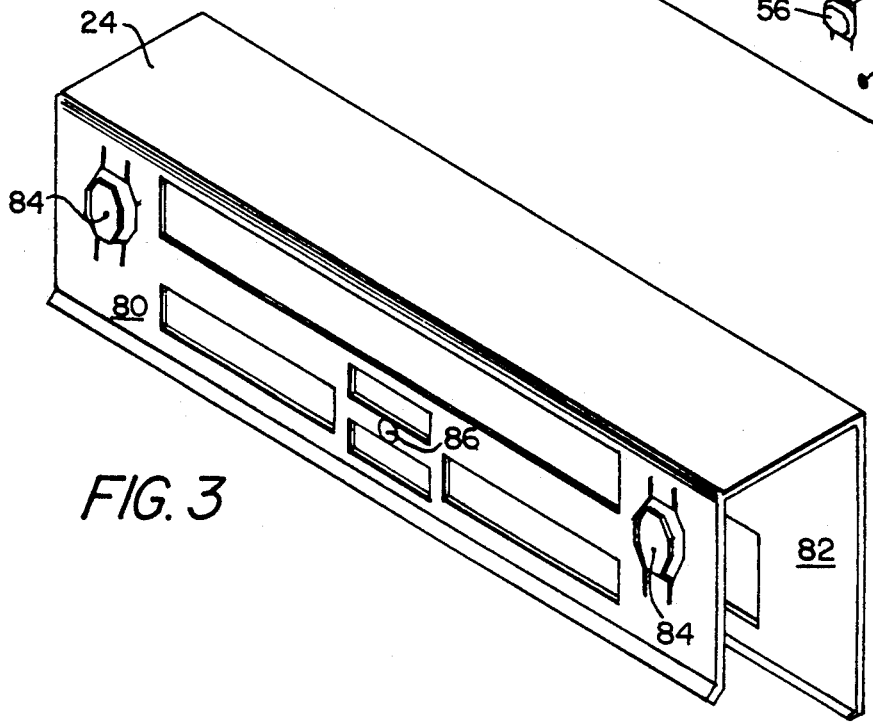
FIG. 3 is a perspective view of a hanger.

Referring to FIG. 3, hanger 24 is formed by folding a steel sheet in a U-shape to form a front plate 80 and a rear plate 82. When installed, the rear surface of the front plate bears against the front surface of the partition wall, and the front surface of the rear plate bears against the rear surface of the partition wall. Front plate 80 has two fastener elements 84 for mating with two keyhole slots 50, 52 (FIG. 2) of a panel. A dimple 86 receives nipple 62.

Referring again to FIGS. 1 and 2, the installation and reconfiguration of the modular support system is extremely simple and fast. In the case of a partition wall, the hanger 24 is first slipped over the top and a top plate is hung onto the hanger using the fastener elements. For a conventional wall, the top plate is screwed to the wall. Once the top plate is in place, additional plates may be suspended using the fastener elements and keyholes. The number of panels may be easily increased or decreased.

Equipment brackets and covers are hung on the panels as needed and may be easily reconfigured.

Other embodiments are within the scope of the following claims.

What is claimed is:

1. A modular system for supporting equipment on a wall comprising support panels, each panel comprising a sheet having columns of keyholes, and a rear support surface lying in a plane parallel to and spaced behind the sheet, the rear support surface including keyholes near the top of the panel and first fastener elements near the bottom of the panel, first fastener elements having the same spacing as the keyholes near the top of the panel, the first fastener elements projecting from the plane of the rear support surface toward the sheet to permit fastening with the keyholes near the top of another panel being hung below it.

2. The modular system of claim 1 wherein the sheet is generally rectangular and the rear support surface projects below the bottom edge of the sheet.

3. The modular system of claim 1 wherein the keyholes in the sheet each have an upper round hole opening into a lower slot, and the keyholes in the rear support surface each have an upper slot opening into a lower round hole.

4. The modular system of claim 1 further comprising a U-shaped hanger for mounting over the top edge of a partition wall, the hanger having a front face with second fastener elements projecting from the plane of the front face, the second fastener elements having the same spacing as the keyholes in the rear support surface of each panel.

5. The modular system of claim 1 wherein the keyholes in the sheet are set in pairs along both columns.

6. The modular system of claim 5 further comprising modular brackets for supporting equipment, each bracket having third fastener elements arranged on the corners of a rectangle and spaced to match the spacing of keyholes in the steel sheet, to permit the bracket to be mounted in any one of at least two different vertical positions on the panels.

7. The modular system of claim 6 further comprising modular covers for covering equipment supported on the modular brackets, each cover having fourth fastener elements arranged on the corners of a rectangle and spaced to match the spacing of keyholes in the steel sheet, to permit the covers to be mounted one above another on the panels.

* * * * *